US005248163A

United States Patent [19]

Dondero

[11] Patent Number: 5,248,163

[45] Date of Patent: Sep. 28, 1993

[54] SKI POLE HANDLE

[75] Inventor: John D. Dondero, Ketchum, Id.

[73] Assignee: Swix Sport Joh. H. Andresen, Norway

[21] Appl. No.: 778,987

[22] PCT Filed: May 15, 1990

[86] PCT No.: PCT/NO90/00081

§ 371 Date: Nov. 14, 1991

§ 102(e) Date: Nov. 14, 1991

[87] PCT Pub. No.: WO90/14136

PCT Pub. Date: Nov. 29, 1990

[30] Foreign Application Priority Data

May 16, 1989 [NO] Norway ..... 891948

[51] Int. Cl.[5] ..... A63C 11/22

[52] U.S. Cl. ..... 280/821

[58] Field of Search ..... 280/821, 822, 823, 819

[56] References Cited

U.S. PATENT DOCUMENTS 2,614,859 10/1952 Harocopo ..... 280/821

4,790,562 12/1988 Skard ..... 280/821

FOREIGN PATENT DOCUMENTS 3512371 10/1986 Fed. Rep. of Germany ..... 280/821

*Primary Examiner*—David M. Mitchell

*Attorney, Agent, or Firm*—Bacon & Thomas

[57] ABSTRACT

A ski pole handle includes a grip element (1) and a main strap (2) fastened to it for transfer of pushing forces from the user's hand to an appurtenant pole (7). The handle includes an elastic auxiliary strap (6) which is fastened to the grip element (1) and is adapted to keep the grip element in a grip position relatively to the hand (8) even if the hand releases the grip element (1).

2 Claims, 1 Drawing Sheet

SKI POLE HANDLE

BACKGROUND OF THE INVENTION

1. Field of the Invention

The present invention relates to a ski pole handle comprising a grip element to which is fastened a strap for transfer of pushing forces from the user's hand to an appurtenant pole.

2. Discussion of the Related Art

By grip element is here meant that element which is adapted to be gripped by the hand. Conventional ski pole handles have grip elements in the form of approximately cylindrical members, most often of approximately oval cross section, but these members may also be bent in such a manner that their upper portions are inclined forwardly in the direction of running during use of the poles. Alternatively the grip elements can be approximately T-shaped members, or they can have lateral protrusions on one or both sides for support of the palm of the hand and/or the thumb, as described in the Norwegian Patent Applications Nos. 86,4260 and 87.0637 U.S. Pat. Nos. 159,639 and 160,415).

Moreover, the grip elements can be shaped in whichever manner, as the present invention is not concerned with any particular shaping of the grip elements.

A strap in the form of a loop is normally fastened on ski pole handles and through which the user's hand is inserted upwardly. Such a strap provides a proper grip for transfer of pushing forces to the pole. The strap does not, however, keep the pole handle accommodated in the hand if the grip of the hand about the grip element ceases. When the hand drops the grip element while the pole is not in contact with a support surface, the pole will fall somewhat down and will hang in the strap, while will lie across the back of the hand or the wrist. It is not possible for the user immediately to reestablish the grip about the grip element. The hand must perform a jerk upwardly in order to bring the grip element to a grip position relative to the hand, or the pole must be pushed against the support surface in order to enable the hand to be moved down to a grip position relative to the grip element.

To re-establish the grip about the grip element in any of these manners is usually not a problem, but during competition racing it is, nevertheless, a disadvantage in that it takes some time to re-establish the grip, and it may also be annoying to ordinary cross-country skiers when the hand cannot immediately grip the grip element after it has been dropped.

The above of course applies to skiing on snow and the use of roller skis on a firm underlayer or support surface.

The problem cannot be solved by means of the strap, as this is situated in such a manner during use that it does not prevent the grip element and the pole from falling somewhat down relatively to the hand when the grip element is dropped.

BRIEF SUMMARY OF THE INVENTION

The above problem is solved by means of the present invention; specifically by means of a ski pole handle as described herein. In accordance with this invention, an auxiliary strap that is elastic is mounted on the ski pole grip at an attachment point that is below the main strap. Accordingly, the auxiliary strap may, in an unstretched condition, have such a length that the grip element is held against the hand even if the grip of the hand about the grip element ceases. Because the auxiliary strap is elastic, it will permit the pole to swing relative to the hand.

The auxiliary strap preferably is fastened to the grip element on the same side as and lower than the main strap, whereby the auxiliary strap, having been wrapped on the hand, extends sloping upwardly and rearwardly (relatively to the running direction), in order to carry the weight of the pole if the hand drops the grip element.

The auxiliary strap may be made of any elastic material, such as for instance rubber.

The invention will hereinafter be explained more detailed by means of an example of an embodiment shown in the accompanying drawing.

DETAILED DESCRIPTION OF THE PREFERRED EMBODIMENT

Figure 1:
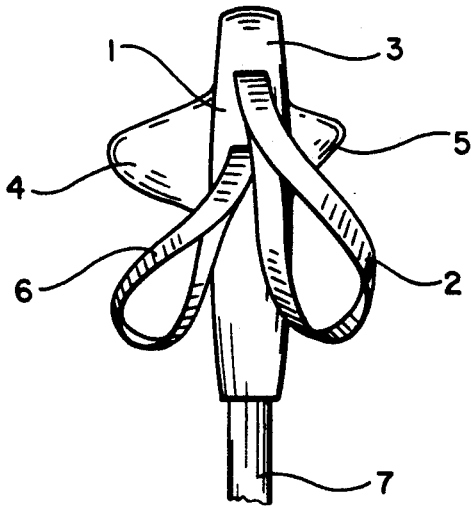
FIG. 1 shows a ski pole handle according to the invention and the uppermost end of an appurtenant ski pole.

The ski pole handle shown in FIG. 1 comprises a grip element 1, which in the example shown has two protruding elements 4 and 5 which provide support for the palm of the hand and the thumb, respectively. The handle is shown mounted at the end of a ski pole 7 and comprises a main strap 2 fastened to one side of an upright knob 3 in accordance with known structure. The side of knob 3 on which strap 2 is secured normally faces towards the user, as is clear in FIGS. 2 and 3.

According to the preferred embodiment of the invention, an elastic auxiliary strap 6 is fastened to the grip element 1 on the same side as an somewhat lower than the main strap 2. For the sake of illustration the two straps are shown hanging somewhat laterally from their attachments. In practice, the auxiliary strap 6 will hang approximately straight down below the main strap 2 when the pole 7 is vertical.

Figure 2:
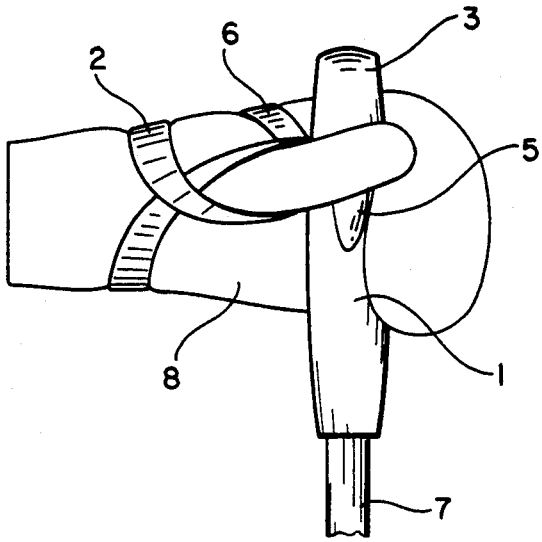
FIG. 2 shows the ski pole handle and a hand gripping the grip element of the ski pole.

FIG. 2 shows the handle and a hand 8 inserted into both of the straps 2 and 6. The auxiliary strap 6 lies tightly against the hand about which it is wound or wrapped in a single turn, as illustrated, and the hand 8 is able to transfer a pushing force to the grip element 1 and the pole 7 through the main strap 2.

Thus, the hand has been inserted from above into the elastic auxiliary strap 6 prior to being inserted upwardly through the main strap 2.

The auxiliary strap 6 may have such a length that it is only slightly stretched when the hand 8 grips tightly about the grip element 1. When the pole swings the auxiliary strap 6 will be extended in order to permit the usual swinging on the pole prior to another pushing phase.

Figure 3:
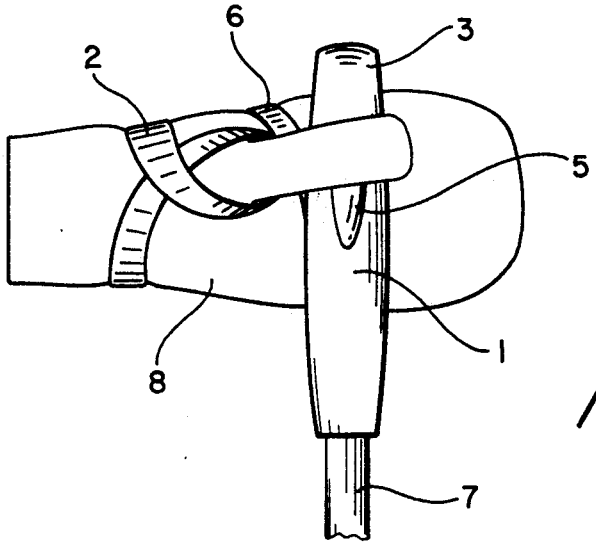
FIG. 3 shows the handle and the ski pole hanging in the auxiliary strap.

FIG. 3 shows a situation where the hand 8 has loosened its grip about the grip element 1. The auxiliary strap 6 keeps the handle in a proper position to be gripped again by the hand 8. Thus, the user can re-establish the grip about the grip element 1 without having to correct the mutual position of the hand 8 and the grip element 1 in advance. Time used for such correction is thereby saved, and unsuccessful attempts to re-establish the grip are avoided.

The invention can be utilized for any ski pole handle which comprises a grip element and a strap adapted to transfer a pushing force from the user's hand to the grip element.

Moreover, the handle can be fastened to a ski pole in any manner, for instance in that the grip element is attached to a sleeve into which the end of the pole is fastened.

The auxiliary strap does not necessarily need to be threaded onto a hand in the manner shown and described, i.e., that the hand is moved down through the auxiliary strap. However, such insertion of the hand causes an advantageous position of the auxiliary strap with respect to keeping the pole up when the hand does not grip the grip element, because the auxiliary strap will be situated "inverted" relatively to the other strap. Another possibility is that the hand can be inserted upwardly through the auxiliary strap, i.e. in the same manner as the hand is inserted upwardly into the main strap. Other ways of using the auxiliary strap are also possible, for instance by moving it onto the hand before the thumb, whereby it will be situated across the back of the hand.

I claim:

1. A handle for a ski pole, the handle comprising:

a grip for manual engagement;

a main strap attached to and extending from one side of the grip and comprising a main loop of pliable material for transferring at least a downwardly manually applied force to the grip;

an auxiliary strap attached to the grip and comprising a loop of elastic material arranged so as to lie closely against the upper side of a hand engaging the grip during use;

said auxiliary strap joining the grip on the same side as and at a point below the attachment point of the main strap of the grip;

whereby the main and auxiliary straps may be wound around a user's hand, with the auxiliary strap resiliently maintaining engagement between a hand and the grip even if the grip is released by the fingers of a hand in gripping engagement with the grip.

2. A handle as claimed in claim 1, wherein the handle includes a rearward side generally facing towards the user, and wherein said main and auxiliary straps are both located on the rearward side of the handle.

* * * * *